US011619040B1

(12) United States Patent
Stanke

(10) Patent No.: US 11,619,040 B1
(45) Date of Patent: Apr. 4, 2023

(54) JOIST INSTALLATION ASSISTING DEVICE

(71) Applicant: Blain Stanke, Wausau, WI (US)

(72) Inventor: Blain Stanke, Wausau, WI (US)

( * ) Notice: Subject to any disclaimer, the term of this patent is extended or adjusted under 35 U.S.C. 154(b) by 0 days.

(21) Appl. No.: 17/540,505

(22) Filed: Dec. 2, 2021

(51) Int. Cl.
*E04B 1/26* (2006.01)
*E04B 1/00* (2006.01)

(52) U.S. Cl.
CPC ..... *E04B 1/2612* (2013.01); *E04B 1/003* (2013.01); *E04B 2001/2652* (2013.01)

(58) Field of Classification Search
CPC ..... E04B 1/2612; E04B 1/003; B27B 27/00; B27B 27/023; B27B 27/02; B27B 27/14; B27B 27/16; Y10T 29/53909; Y10T 29/53913; Y10T 29/23935; E04G 21/1841; E04G 21/185; E04G 21/1891; E04G 21/16
See application file for complete search history.

(56) References Cited

U.S. PATENT DOCUMENTS 1,990,763 A * 2/1935 Curry ..... B65B 17/02 29/270
4,753,014 A * 6/1988 Vrajich ..... G01B 3/30 33/613
4,836,517 A * 6/1989 Vossler ..... E04G 21/26 269/904
5,054,755 A * 10/1991 Hawkes ..... B25B 11/00 269/254 R
5,228,667 A * 7/1993 Bridegum ..... E04D 13/158 269/45
5,462,264 A 10/1995 Delagera
5,490,334 A * 2/1996 Payne ..... E04G 21/1891 269/904
6,126,156 A * 10/2000 Brodeur ..... B25B 9/00 269/6
6,272,951 B1 * 8/2001 Lambson ..... E04B 1/2612 81/488
6,761,005 B1 7/2004 Daudet
6,820,868 B1 * 11/2004 Reymus ..... E04F 21/1855 33/645
6,851,884 B2 2/2005 Eberle
8,001,668 B2 * 8/2011 Coffman, Jr ..... E04G 21/1891 29/283
8,672,600 B2 3/2014 Reznar
9,700,931 B2 7/2017 Wadsworth
2003/0009983 A1 * 1/2003 Thomas ..... E04G 21/1891 52/749.1

(Continued)

*Primary Examiner* — Theodore V Adamos
(74) *Attorney, Agent, or Firm* — Carlin Law LLC

(57) ABSTRACT

A joist installation assisting device to assist with the installation of a joist on a ledger board or similar device. The joist installation assisting device being constructed of a durable material and being generally u-shaped, such that a pocket is formed for placement of a joist hanger, and then a joist therein. The joist installation assisting device further comprising an upwardly projected point for the quick accurate placement of the device upon the ledger board. The joist installation assisting device having a plurality of openings therethrough for attachment and detachment to the ledger board by anchoring devices. An adjustment mechanism member being positioned in a vertical y-dimensional axis to contact with the lower portion of the joist to allow for precise positioning in the y-dimensional axis prior to securing and installation of said joist.

19 Claims, 8 Drawing Sheets

(56) References Cited

U.S. PATENT DOCUMENTS

| | | | | |
|---|---|---|---|---|
| 2005/0212314 | A1* | 9/2005 | Roderick | B25B 27/00 294/211 |
| 2009/0188187 | A1 | 7/2009 | Studebaker | |
| 2015/0218832 | A1* | 8/2015 | Peters | E04B 5/12 269/46 |
| 2016/0052110 | A1* | 2/2016 | Erdman | B25B 27/00 29/271 |
| 2017/0037830 | A1* | 2/2017 | Nielsen | F03D 13/10 |
| 2022/0049511 | A1* | 2/2022 | Duncan | E04B 1/003 |

* cited by examiner

JOIST INSTALLATION ASSISTING DEVICE

FIELD

The present disclosure is directed to the field of construction, specifically as related to joist or beam installation, and more particularly to devices for assisting with the accurate placement of decking, flooring, and other structural related joists, girders, and/or beams in a linear or parallel fashion.

INTRODUCTION

Decks are frequently installed on residential buildings throughout the nation, and occasionally on commercial buildings as well. As with many construction projects, proper and accurate installation of decks is difficult. Improper installation can create problems that are not immediately apparent.

Generally, open spaces are left between the planks of the deck board on a deck for liquid to move through. Without proper spacing, the wood may hold water and rot out. However, it is known that wood expands, contracts, and may additionally swell due to changes in temperature and moisture throughout weather changes in a calendar year. Thus, the exact width of the spacing between deck board planks will fluctuate throughout a year or even season.

To prevent or minimize some of these issues, a few installers of decks will independently install joist hangers or the like for the placement of boards or joists. This naturally will slow the installation time and increase the price of installation. Further, this method may also require additional personnel to assist with holding a joist in place and moving in the x, y, and z dimension for accurate placement.

Unfortunately, boards may vary in length, width, and thickness, despite being listed as exact measurement equals. Thus, one placed board may have a different height when defined relative to the lower part of a deck board as to a ground or bottom level structure. This will result in a slightly uneven deck board flooring, or soft spots in said flooring.

As previously mentioned, the warping or swelling of boards could cause the angle of such an uneven flooring to increase and decrease throughout a given year. Additionally, weight load capacity is not consistent, and attachment devices such as screws or nails could be worked out of position over a period of time.

What is needed, therefore, is a device which can increase the consistency of the placement and location for joists, beams, or the like, while also further increasing the speed of installation.

BRIEF SUMMARY OF THE INVENTION

The present invention is directed to a Joist Installation Assisting Device for the rapid installation and accuracy for placement of joists, beams, girders, boards, or the like as to the creation and installation of a deck, floor, porch, veranda, balcony, or the like.

There are many different parts to a deck, and some of the terminology will change based on region or locality. Other terms are used both formally and colloquially, and thus some confusion will occur.

As used herein, the terms joist, girder, and beam while having construction-related different, are to be synonymous as related to the present disclosure and are to be defined and used generally herein as a joist.

Further, it is well known and established that boards can be made of wood, wood composite, metal, plastic, or any other durable material, and for brevity and ease of reading, the use of the term board herein shall encompass all such materials.

Further, deck installation as used and discussed herein is generally synonymous with porch, patio, balcony, veranda, or the like installation, and even flooring, ceiling, and roof installation in some regards. Thus, the discussion herein of deck installation is expressly intended to further encompass all such terms, but like other definitions are defined and used herein as deck for brevity and ease of use on the reader.

A ledger board is installed to act as a guide for a deck frame and is attached to the exterior of a building wall. Rim joists are defined as the other outside edges of the deck, all together creating the deck frame. Boards on the interior of the deck frame and running parallel as to the ledger board are defined as intermediate joists. Beams may be defined herein as to be running perpendicularly as to joists.

Deck board is defined as the top surface of a deck, and the flooring upon which a human person will walk, and place deck furniture shall be defined as the deck board flooring herein.

Joist hangers, which may also be known as joist fasteners, are used to allow for boards to be attached perpendicularly to an edge such as a joist, rim joist, beam, or ledger board. Thus, joist hangers are intended to create a "T" shape, and ultimately an "H" shape as to both ends of a perpendicularly attached board. For some deck installations, a perpendicularly run beam or double beam is installed, then joist hangers are placed, and joists are then placed within said joist hanger and attached thereto with an installation or attachment member such as a screw, bolt, nail, or the like.

The invention disclosed herein is known as a Joist Installation Assisting Device. As disclosed, it is an object of the invention to hold a joist hanger and allow for accurate and rapid placement thereof. After the joist hanger is in place, a joist is installed within the joist hanger, whereupon a securing device such as a nail, screw, or the like, can secure the joist in place. The Joint Installation Assisting Device may then be disengaged from its position, whereupon the joist hanger and joist therein are in a secured final position.

It is presently thought that the body member of the Joist Installation Assisting Device has a generally U-shaped, or a c-shaped depending on the angle of viewing, body member. The body member may be constructed of any durable non-malleable material such as aluminum, aluminum alloy, metal, plastic, wood, glass, or similar. The body member is three-dimensional in nature with a front, rear, and interior width thickness. The exact shape of the body member may slightly change wherein the "U" shape may be flared out with wings. This winged portion would allow for easier installation to a board while setting a joist hanger or joist and is presently contemplated to be within the spirit of the invention.

The interior of the body member "U" or "C" is a channel, said channel being described as the opening interior of the "U", and created by the interior space as to the side vertical walls and the bottom wall of the "U" itself. The thickness, or the width, of the body member creates said channel. This channel, which may also be referred to as a pocket, is the area where a joist hanger may be set or placed. After a joist hanger is placed within the channel, the joist itself is placed within the channel and the joist hanger therein.

On or near the rear face of the body member is a point, or a triangle, assisting member, or guide, known as an apex point. This apex point or similar is a generally centrally located point, as to the interior of the channel within the "U". Said point is a center line locator and allows for an installer of said Joist Installation Assisting Device to quickly locate a center line on a mounting board, place the apex point in a linearly located position as to said center line, and mount the Joist Installation Assisting Device to said mounting board for rapid and accurate placement thereof.

The apex point is extended vertically away from the bottom wall of the "U" channel. It is presently thought that the apex point may be attached by means of a secondary component or be located vertically away from said bottom wall as just-mentioned, though additionally may not be located within said channel. Thus, in this particular method, the apex point is a secondary component attached to the rear face of the body member.

The mounting of the Joist Installation Assisting Device is achieved by a mounting hole on the body member. The mounting hole is a defined opening between the front face of the body member all the way through the rear face of the member. This allows for an installer to place a screw, nail, bolt, or other mounting or anchoring device all the way through the width of the Joist Installation Assisting Device for attachment or mounting of the Joist Installation Assisting Device itself.

By way of example: an installer places a screw into the mounting opening where the tip of the screw extends through and beyond the rear face of the Joist Installation Assisting Device. The screw tip contacts with a board for the Joist Installation Assisting Device to be mounted upon, and the installer begins anchoring the screw into said board. The screw head is wider than the mounting opening, and thus secures the Joist Installation Assisting Device in place. If a second mounting opening is provided, the installer repeats the just-mentioned process, and the Joist Installation Assisting Device is thus secured in place.

Continuing on, the Joist Installation Assisting Device may additionally comprise a mounting wing. The mounting wing is an external projection from the front face of the body member, extended perpendicularly therefrom. The mounting wing is additional material which further contains an attachment opening which runs in a y-axis as to the body member. In such a fashion, the attachment opening is a hole defined and extended through the mounting wing itself.

Within the attachment opening of the mounting wing is an adjustment mechanism member. The member is presently thought to be a linear component that has an adjustment wing or adjustment head on one end of the member, at the exterior of the attachment opening at a position opposing that of the "U" channel, as will be made clear in the drawings. The other end of the member will be a striking surface. The striking surface will make contact with a joist or board that is placed within the channel of the Joist Installation Assisting Device. A human user will then actuate the adjustment member by turning counterclockwise or clockwise if the member is threaded or partially threaded, or by applying force thereto. This actuation will in turn cause the striking surface of the member to move vertically into the channel, and alternatively away from the channel. Such movement will thus directly cause the joist within said channel to move vertically concurrently with said striking surface. This allows a user to have adjustability in the y-axis, also known as vertically, and this in turn may help to prevent an uneven decking floor, as previously mentioned.

Thus, when the Joist Installation Assisting Device is placed in position, said Joist Installation Assisting Device will be positioned onto a mounting board based on a center line position. The positioning will be adjusted based on the apex point until the human user is satisfied in its positioning on said mounting board. The Joist Installation Assisting Device will be attached to the mounting board by screws, nails, or the like. Next, a joist hanger will be placed within the channel of the Joist Installation Assisting Device. A joist will be placed within the joist hanger positioned within the channel of the Joist Installation Assisting Device. The joist vertical positioning will be adjusted by the adjustment member. Then, the joist hanger will be installed on the mounting board by screws or attachment devices. The Joist Installation Assisting Device will then be detached by removing the screws, nails, or the like.

These and various other features, advantages, modes, and objects of the present invention will be made apparent from the following detailed description and any appended drawings.

BRIEF DESCRIPTION OF THE DRAWINGS

One or more preferred exemplary embodiments of the present disclosure are illustrated in the accompanying drawings in which like reference numerals represent like parts throughout and in which.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE INVENTION

Figure 1:
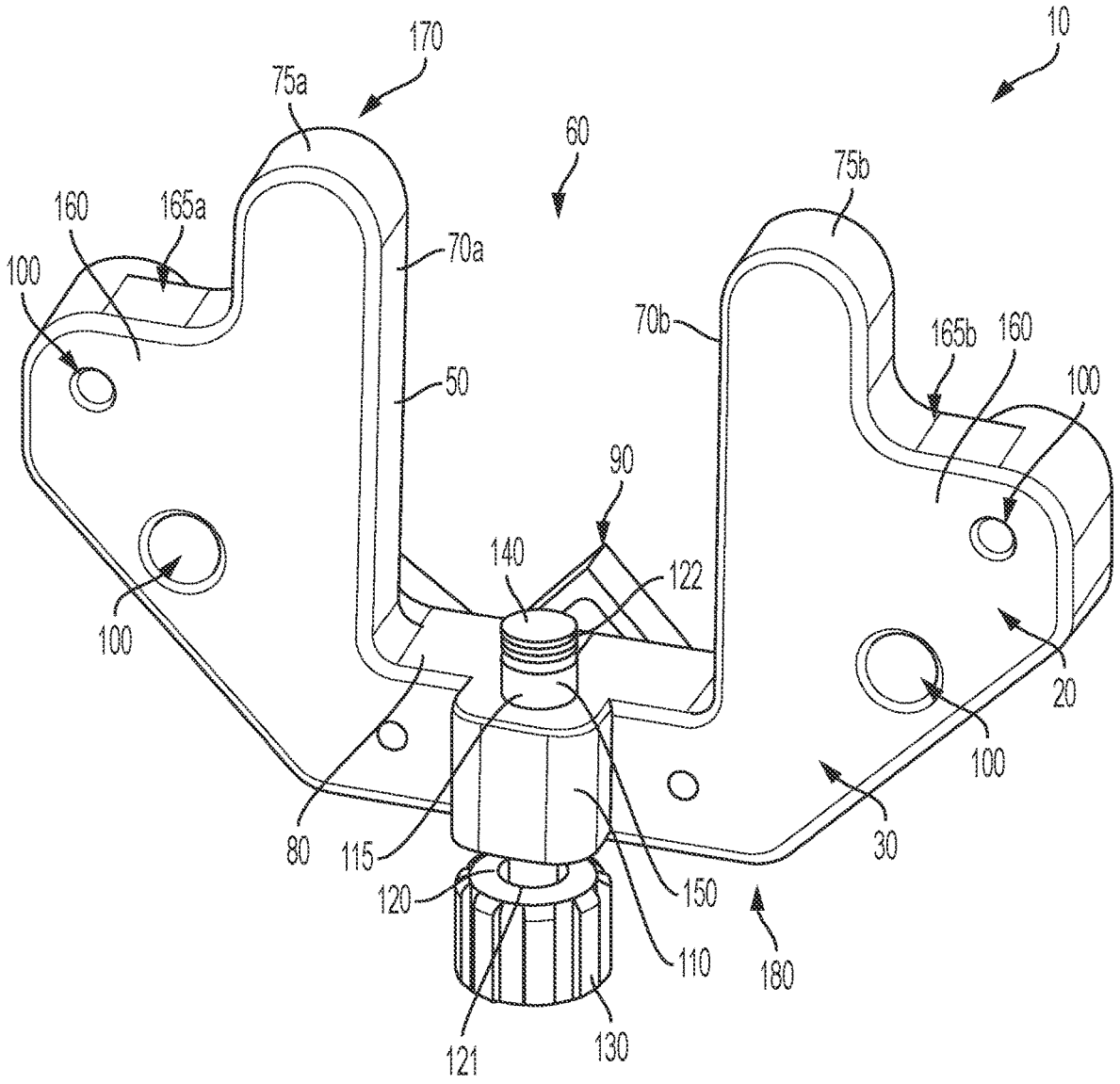
FIG. 1 is a perspective front view of a preferred embodiment of the Joist Installation Assisting Device.

Referring now to the drawings in detail, FIG. 1 illustrates a preferred embodiment of a Joist Installation Assisting Device 10 constructed in accordance with the present disclosure wherein the body member 20 highlights the generally U-shaped nature, at the front face 30. As has been previously mentioned, with the generally U-shaped nature, the body member 20 consists of a width thickness 50. The u-shape is formed by way of side walls 70*a* 70*b* with a lower connecting base wall 80, all together forming said u-shape. Said side walls 70*a* 70*b* are spaced and opposing in nature, with the base wall 80 being the bridging section creating the shape of the "U" therefrom. The previously mentioned width 50 creates a tool pocket, otherwise known as a U-shaped channel 60 as to the side walls 70*a* 70*b* and the base wall 80.

On the ends of the side walls 70*a* 70*b* which is opposing the base wall 80 are the top of the side walls 75*a* 75*b*. This may in some instances flare outwards as to the base wall 80 into wings of the body 160, otherwise known as additional material therefrom. The top of the side walls 75*a* 75*b* and the upper portion of the wings of the body 165*a* 165*b* together form the upper face 170. Opposing said upper face 170 on the lower end of the body member 20 is the lower face 180. The wings of the body 165*a* 165*b* as shown here extend away from a vertical axis created from a central point on the base wall 80 bridging section.

Figure 2:
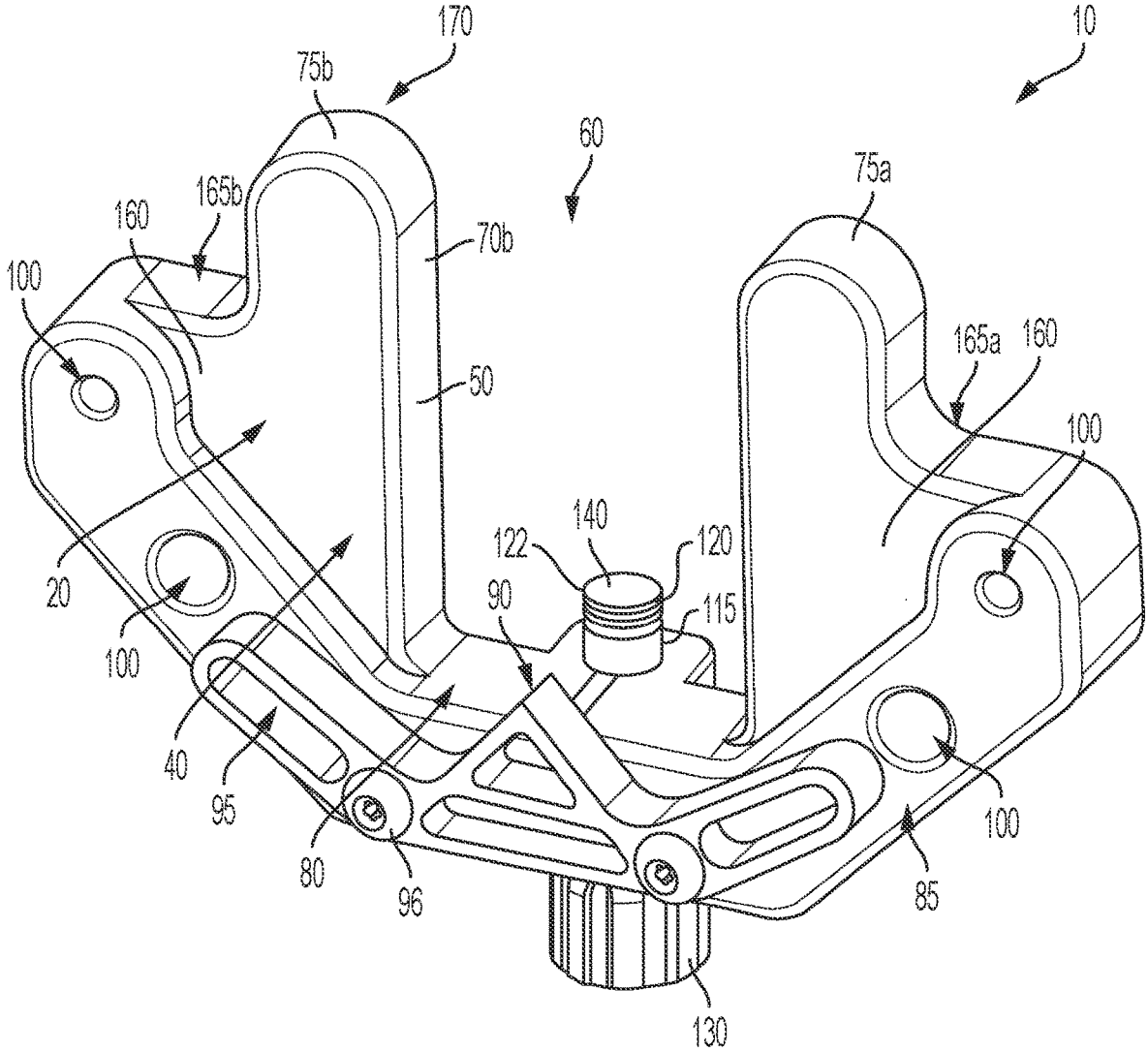
FIG. 2 is a perspective rear view of a preferred embodiment of the Joist Installation Assisting Device.

Within the width of the body member 20 of the Joist Installation Assisting Device 10 is at least one defined opening 100, otherwise known as a mounting hole. This defined opening 100 is an open space between the front face 30 extending through the width 50 of the body member 20 to the rear face 40, as shown in FIG. 2. Turning back to FIG. 1, an apex point 90 is shown, extending above a horizontal plane defined within the width 50 of the base wall 80. Said apex point 90 thus extends partially vertically away from the base wall 80 generally towards the top of the side walls 75*a* 75*b* within the U-shaped channel 60. This apex point 90 is outside of the U-shaped channel 60 and is intended generally to contact with a external position for straight alignment of the Joist Installation Assisting Device 10, as can be appreciated by viewing FIG. 4.

Resuming the review of FIG. 1, a mounting wing 110 is shown, which is also known as additional material extending away from the front face 30 of the Joist Installation Assisting Device 10. This additional material has an attachment opening 115 therethrough. This may also be defined as an open space in the vertical direction, or y-dimension, as to a plane created by the top of the mounting wing 110 and base wall 80, and a plane created by the bottom of the mounting wing 110 and the lower face 180. This attachment opening 115 thus allows for an adjustment mechanism member 120 with a first end 121 and a second end 122 to be inserted therethrough as shown.

On the first end 121, an adjustment head 130 is attached, formed, or connected, allowing for a user to rotate said adjustment mechanism member 120 around a central location therefrom, or pull or push said adjustment mechanism member 120 vertically towards or away from the vertical direction, otherwise known as y-direction, which is defined herein as the direction between the upper face 170 and the lower face 180.

Figure 6:
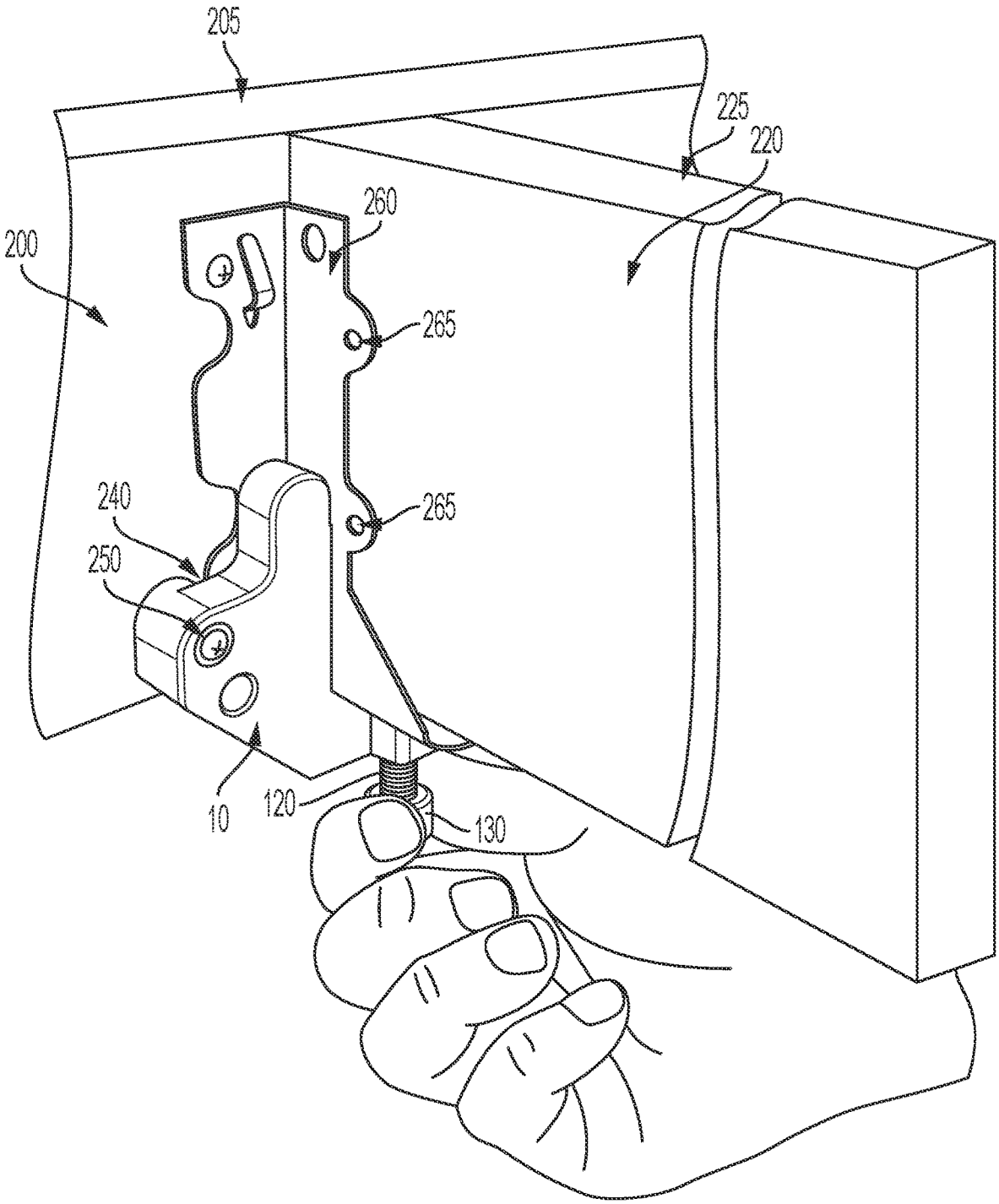
FIG. 6 is a view of a human user actuating an adjustment member of the Joist Installation Assisting Device of the present disclosure.

On the adjustment member second end 122 is a striking surface 140, which is the uppermost contact point of said adjustment mechanism member 120 and allows for physical adjustment as can be appreciated by viewing FIG. 6.

Returning to FIG. 1, the adjustment mechanism member 120 may be partially threaded, wherein if the attachment opening 115 were to additionally comprise threaded components 150, as is optionally considered and contemplated within the scope of the present disclosure, turning or otherwise actuating said adjustment mechanism member 120 either clockwise or counterclockwise will cause the threaded components 150 to so interact and thus the adjustment mechanism member 120 will consequently advance or retreat in the vertical direction, otherwise known as the y-dimension.

Now looking to FIG. 2, the rear face 40 of an embodiment of the Joist Installation Assisting Device 10 according to the present disclosure is shown. The width 50 of the body member 20 is shown as previously mentioned and creating the pocket of the U-shaped channel 60. On said exterior rear face 40, an external projection 85 is formed, attached, or connected, which allows for extra thickness away from said rear face 40. As can be appreciated by FIG. 6, this will allow for room between the rear face 40 and a contact surface upon which the Joist Installation Assisting Device 10 will be mounted upon.

Looking back to FIG. 2, upon the external projection 85, an optional apex point projection 95 is attached to the external projection 85 by way of a mounting component 96. The apex point projection 95 is an additional piece of material to allow for excess room away from said external projection 85. As was previously referred to, the mounting holes 100 of the front face 30 as shown on FIG. 1 are entirely through the width 50 of the body member 20 as shown here, allowing for access through to the rear face 40 of the Joist Installation Assisting Device 10. Further, it can be appreciated here in FIG. 2 the positioning of the adjustment mechanism member 120 and the vertically extended striking surface 140 extending vertically away from the base wall 80, or the plane created by said base wall 80 and the uppermost portion of the mounting wing 110 as shown in FIG. 1.

Figure 3:
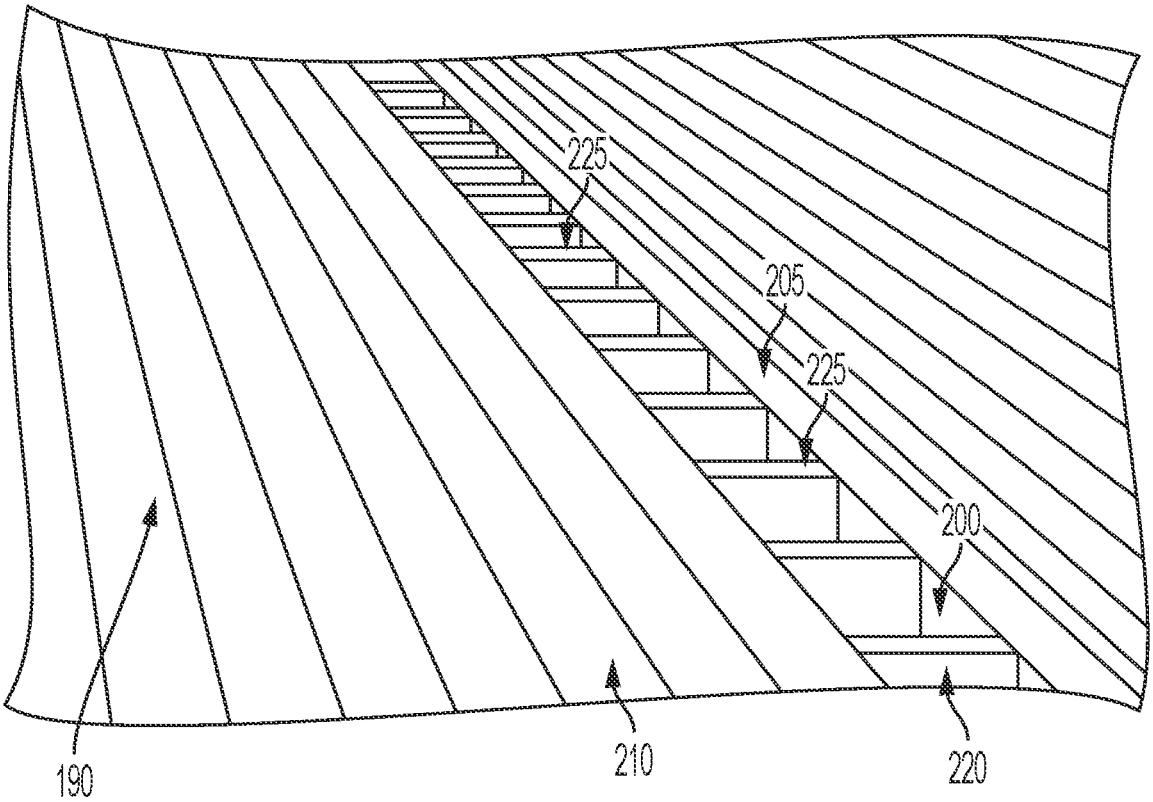
FIG. 3 is a view of a generic deck in a partially constructed state.

FIG. 3 illustrates a generic deck 190. The outermost board nearest the building is attached via a ledger board 200. Extending generally perpendicularly away therefrom are a plurality of joists 220. As is shown here, each joist 220 is generally even and creates a plane on the upper portion of said joists 225, which is where boards or a subfloor and then boards are to be placed, which in turn creates the deck flooring 210. As those with skill in the art know, generally the upper portion of a joist 225 is even with the upper portion of a ledger board 205, or rim joist, or similar mounting board as previously discussed. As is now clear, should a joist 220 be off-line as to the created plane of all joist upper portions 225 and with the upper portion of a ledger board 205, then the deck flooring 210 laid upon will have a gap or become otherwise cattywampus.

Figure 4:
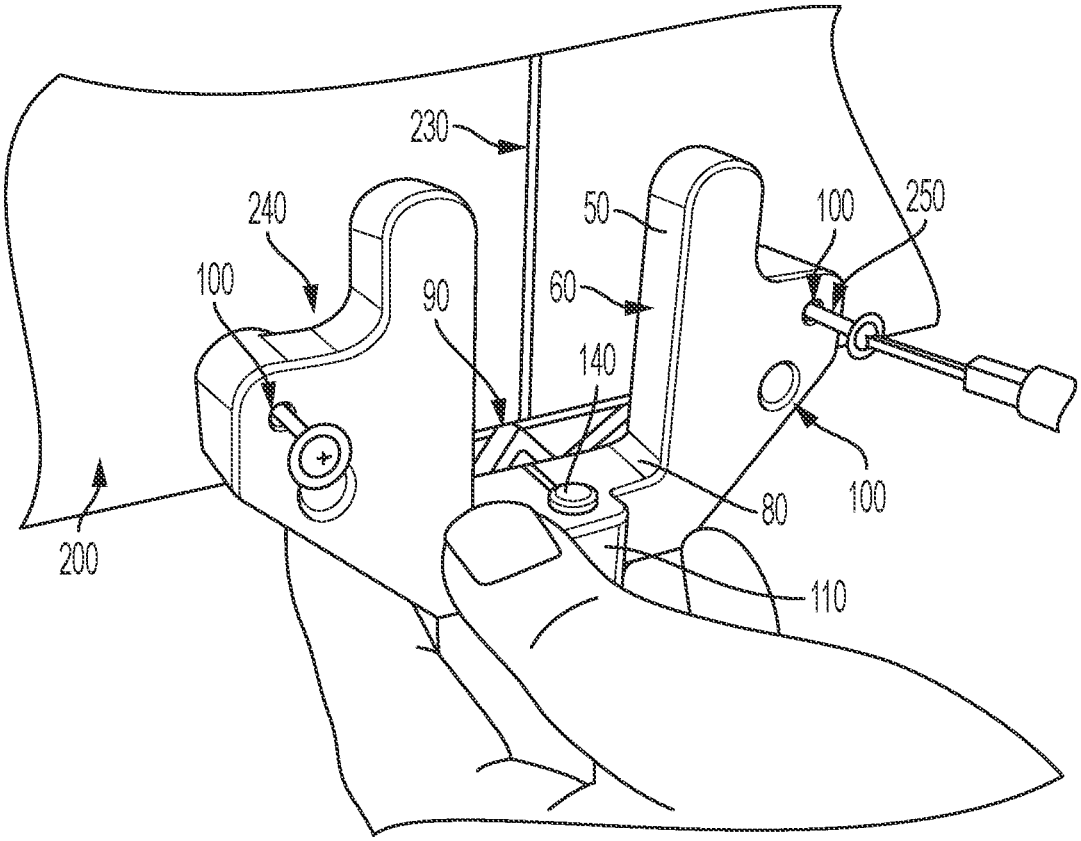
FIG. 4 is a view of a preferred embodiment of the Joist Installation Assisting Device being mounted in position with an attachment device through a mounting opening.

As we now turn to FIG. 4, the Joist Installation Assisting Device 10 is shown being installed or mounted upon a board such as a ledger board 200, though as it is known and appreciated by those with ordinary skill in the art of construction, that this may be installed on any generally flat surface or board to achieve the same or similar result. The desired position on a ledger board 230 is first ascertained. The apex point 90 is positioned in a linear position under said desired position 230, and contact is made by the apex point 90 with the lowermost portion of the ledger board 200. As is shown, anchoring devices 250 such as screws, nails, bolts, or the like are then inserted through a mounting hole 100 or a plurality thereof. At this point, anchoring devices are secured through the mounting hole 100 to the ledger board 200. A gap 240 is thus created between the Joist Installation Assisting Device 10 and the ledger board 200 after mounting thereto.

Figure 5:
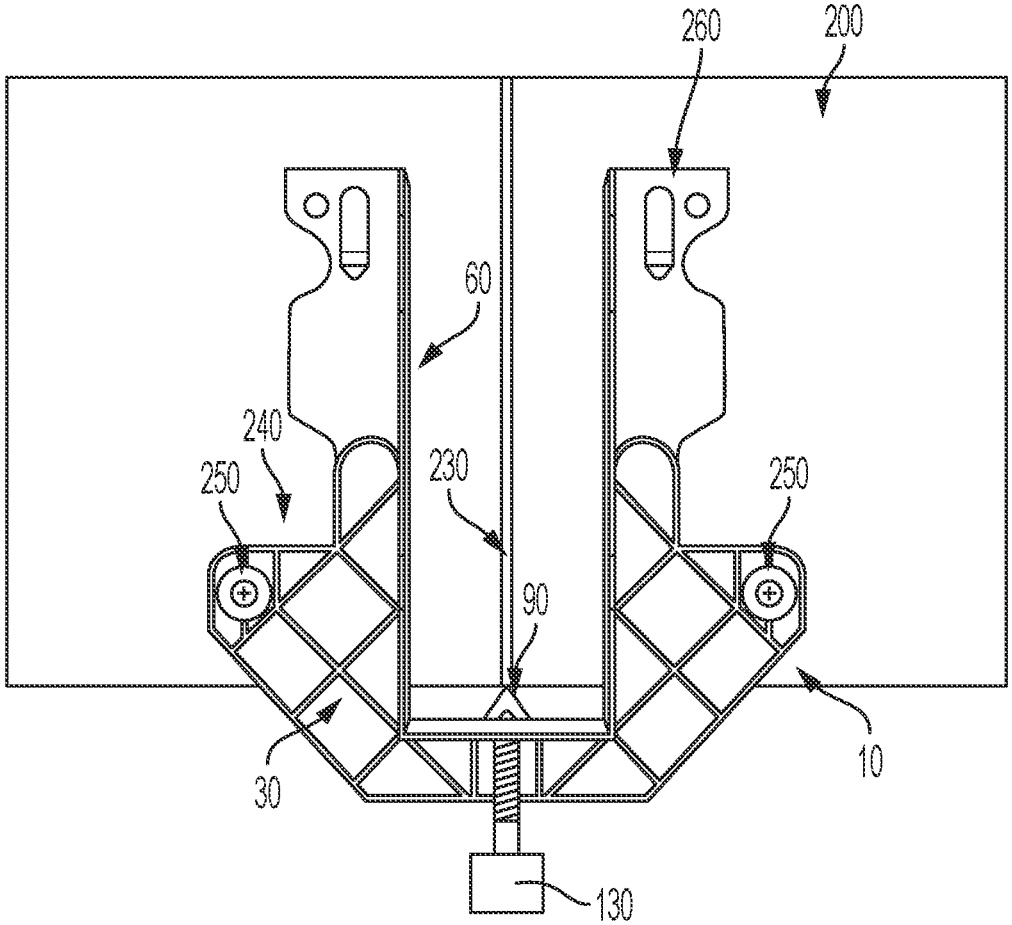
FIG. 5 is a perspective view of a preferred embodiment of a mounted Joist Installation Assisting Device wherein a joist hanger has been positioned within the channel.

Reviewing FIG. 5, it is shown how due to the gap 240 created between the ledger board 200 and the Joist Installation Assisting Device 10 a joist hanger 260 can fit within the U-shaped channel 60. As the Joist Installation Assisting Device 10 is mounted to the ledger board 200 by way of anchoring devices 250, and the joist hanger 260 is placed within the U-shaped channel 60, a pocket still exists within said channel 60, which allows for the receipt of a joist 220, as shown in FIG. 6. In such a fashion, it is evident that a user can place the Joist Installation Assisting Device 10 and joist hanger 260 prior to inserting a joist 220, freeing up both of a human user's hands for said step.

As we look closer at FIG. 6, the Joist Installation Assisting Device 10 has now been mounted or attached by way of anchoring device 250 to the ledger board 200. A joist hanger 260 has been positioned within the U-shaped channel 60 and the gap 240. Additionally, a joist 220 has been positioned within the U-shaped channel 60 and the joist hanger 260 itself, preparing positioning for installation. Previously discussed, those with skill in the art know it is desirable to level the upper portion of a joist 225 with the upper portion of a ledger board 205. As described in detail above, twists and warps and general not exact measurements of boards may result in differences between said upper portion of a joist 225 and upper portion of a ledger board 205. In such a circumstance, the upper portion of a joist 225 may need to be moved in the y-dimension so as to equal the height of the upper portion of the ledger board 205. As is depicted here, a human user is actuating the adjustment head 130 of the adjustment mechanism member 120, which as previously described will induce the striking surface 140 of the adjustment mechanism member 120 to contact with the lower portion of the joist 220, and thus manipulate the exact positioning of said upper portion of the joist 225 so as to equal the planar positioning of the upper portion of the ledger board 205. At such a position, the joist 220 will then be secured in position with attachment methods such as screws, nails, or the like through the joist hanger attachment openings 265 of said joist hanger 260. The human user will then disengage the adjustment mechanism member 120 from contact with the joist 220, the anchoring devices 250 securing the Joist Installation Assisting Device 10 in place on the ledger board 200 will be removed, and the Joist Installation Assisting Device 10 itself can be removed therefrom.

Figure 7:
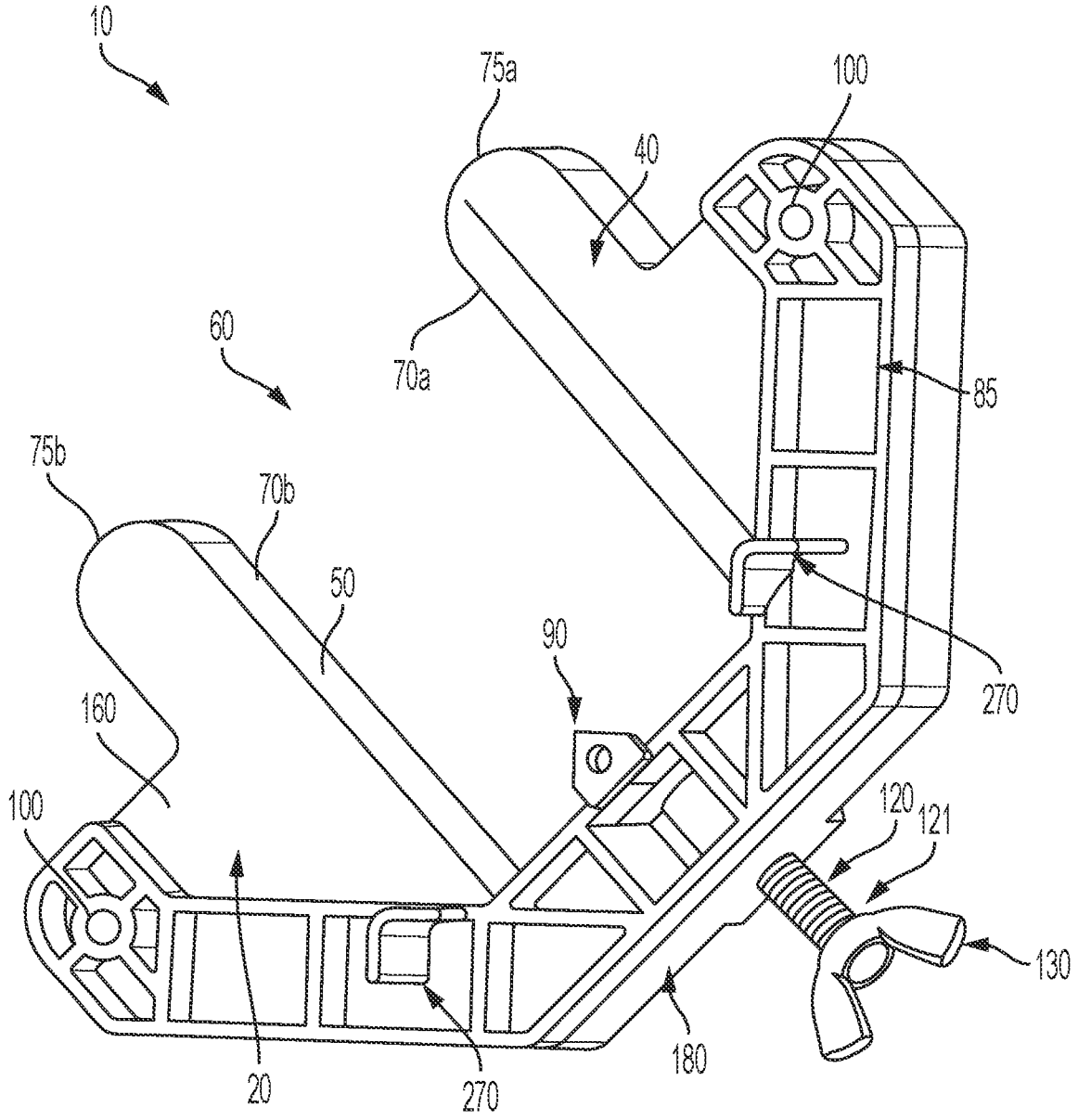
FIG. 7 is a rear view of an alternative embodiment of the Joist Installation Assisting Device highlighting optional additional bump stop positioning components.

FIG. 7 depicts an alternative embodiment of the Joist Installation Assisting Device 10, highlighting the rear face 40 thereof. The body member 20 in this embodiment additionally comprises a plurality of bump stops 270 on the external projection 85. The bump stops 270 allow for rapid positioning of the Joist Installation Assisting Device 10 on a mounting position board. As such, the bump stops 270 are generally linearly positioned with each other and with the apex point 90. In this particular embodiment, the apex point 90 is formed attached molded or otherwise attached to the external projection 85 itself, without need for additional materials or projection.

Figure 8:
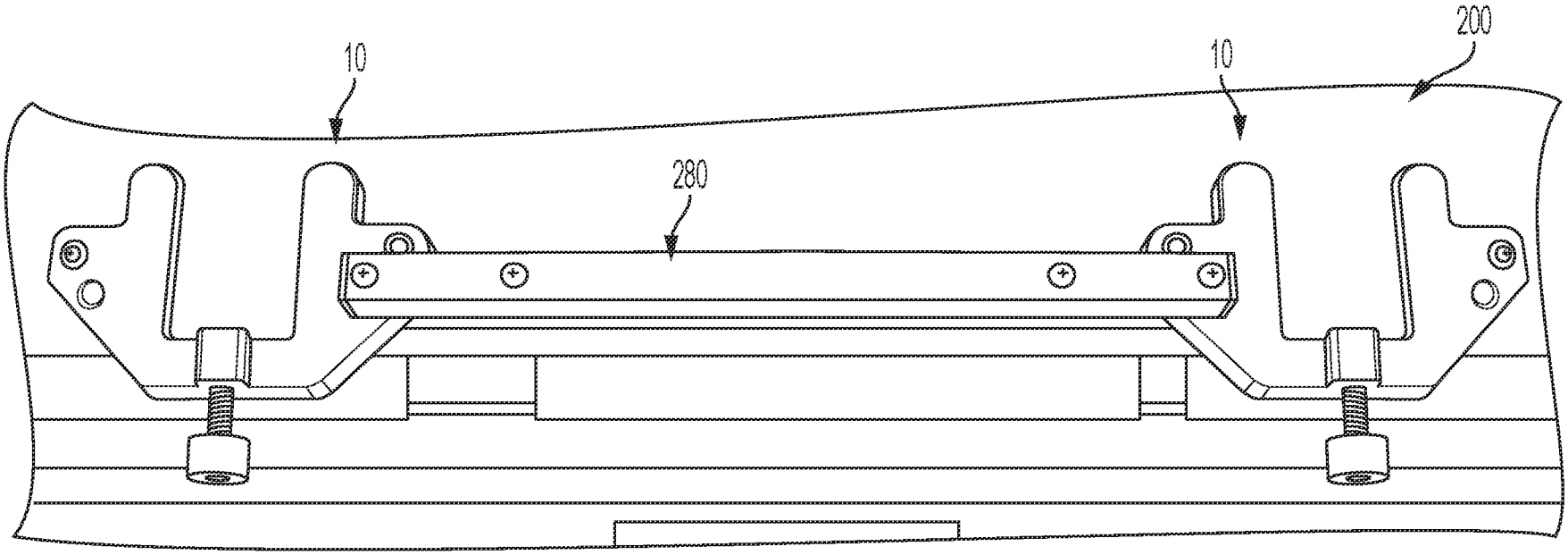
FIG. 8 is a plurality of the Joist Installation Assisting Devices utilizing a connection rod.

Lastly, we look at FIG. 8, wherein an additional component known as a connection rod 280 is utilized. Two Joist Installation Assisting Devices 10 are positioned on a ledger board 200. The connection rod 280 is attached to each Joist Installation Assisting Device 10 by way of anchoring devices 250 placed through one mounting hole 100 of the first Joist Installation Assisting Device 10, and through one mounting hole on the second Joist Installation Assisting Device 10, creating a connection bridge therebetween. This connection rod thus allows for rapid placement of two Joist Installation Assisting Devices 10 at any one time, for rapid installation of a plurality of joists 220.

Understandably, the present Joist Installation Assisting Device 10 has been described above in terms of one or more preferred embodiments or models. It is recognized that various alternatives and modifications may be made to these embodiments and methods that are within the scope of the present invention. Various alternatives are contemplated as being within the scope of the present invention.

It is also to be understood that, although the foregoing description and drawings describe and illustrate in detail one or more preferred embodiments of the Joist Installation Assisting Device 10, to those skilled in the art of which this invention relates, the present disclosure will suggest many modifications, models, and constructions, as well as widely differing embodiments and applications without thereby departing from the spirit and scope of the invention.

What is claimed is:

1. An assisting device for securing joists, said assisting device comprising:

a body member having a front face, and a rear face, wherein a width is defined between the front face and the rear face;

the body member further comprising a substantially U-shaped channel defined by a pair of spaced apart side walls and a base wall adapted to receive a portion of a joist;

a vertically extending apex point connected to the base wall of the body member and wherein said apex point extends vertically from the base wall towards top ends of the side walls;

a defined opening extending from the front face to the rear face of the body member for receiving an anchoring device;

a mounting wing extending substantially perpendicularly from the body member front face, wherein the mounting wing comprises an attachment opening; and an adjustment mechanism member comprising a first end and a second end, and further received within the mounting wing attachment opening, the adjustment mechanism member having an adjustment head at the first end.

2. The assisting device of claim 1, wherein said rear face of the body member additionally comprises an external projection.

3. The assisting device of claim 2, further comprising a plurality of defined openings extending from the front face to the rear face of the body member for receiving a plurality of anchoring devices.

4. The assisting device of claim 3, wherein said body member is comprised of one of aluminum, aluminum alloy, and plastic.

5. The assisting device of claim 4, further comprising a plurality of bump stops on the external projection.

6. The assisting device of claim 5, wherein said bump stops are generally linearly positioned with the apex point.

7. The assisting device of claim 4, wherein the assisting device comprises a first assisting device and a second assisting device identical to the first assisting device is provided, and further comprising a connecting rod having a first end and a second end, said first end of the connecting rod is attached to one of the defined openings of the first assisting device by way of an anchoring device therethrough, and wherein said second end of the connecting rod is attached to one of the defined openings of the second assisting device by way of an anchoring device therethrough.

8. A joint installation assisting device adapted for receipt of a joist hanger and a joist, said assisting device comprising:

a generally U-shaped body member having a front face, a rear face, two spaced and opposing parallel side walls, and a bridging section base wall connected to one end of each side wall forming a generally U-shaped channel therein;

an external projection attached to the rear face of the body member;

an apex point projection component comprising of a vertically extending apex point thereon, wherein said apex point projection component is attached to the external projection on the rear face of the body member, wherein said apex point extends from the apex point projection component vertically away from said bridging section;

a mounting wing having a top end and a bottom end, said mounting wing extending substantially perpendicularly from the bridging section of the generally U-shaped body member, wherein the mounting wing additionally comprises and defines an attachment opening between the top end and the bottom end of said mounting wing therethrough;

a partially threaded adjustment mechanism member positioned and projecting outwardly from the attachment opening of the mounting wing above the top end and below the bottom end thereof, said partially threaded adjustment mechanism member having a first distal end and a second distal end;

an adjustment head positioned at the first distal end of the partially threaded adjustment mechanism member and positioned outside the generally U-shaped body member;

a striking surface positioned at the second distal end of the partially threaded adjustment mechanism member; and wherein when the adjustment head of the partially threaded adjustment mechanism member rotates one of clockwise and counterclockwise, the first distal end of the threaded member extends farther away from the attachment opening of the mounting wing.

9. The joint installation assisting device of claim 8, wherein the body member is comprised of one of aluminum, aluminum alloy, and plastic.

10. The joint installation assisting device of claim 9 further comprising a plurality of defined openings extending from the front face to the rear face of the body member for receiving a plurality of anchoring devices.

11. The joint installation assisting device of claim 10, further comprising a plurality of bump stops on the external projection.

12. The joint installation assisting device of claim 11, wherein said bump stops are generally linearly positioned with the apex point.

13. The joint installation assisting device of claim 12, wherein the assisting device comprises a first assisting device and a second joint installation assisting device identical to the first assisting device is provided, and further comprising a connecting rod having a first end and a second end, said first end of the connecting rod is attached to one of the defined openings of the first joint installation assisting device by way of an anchoring device therethrough, and wherein said second end of the connecting rod is attached to one of the defined openings of the second joint installation assisting device by way of an anchoring device therethrough.

14. A joint installation assisting device for securing boards to a structure, said device comprising:

a generally U-shaped body having a front face and a rear face, an exterior portion, and an interior tool pocket portion adapted to receive a board;

wherein said interior tool pocket portion comprises a lower base wall portion having a first distal end and a second distal end;

a first interior side wall having a top end and a bottom end, wherein said first interior side wall is connected to said lower base wall portion first distal end at said first interior side wall bottom end and extends vertically away therefrom;

a second interior side wall having a top end and a bottom end, wherein said second interior side wall is connected to said lower base wall portion second distal end at said first second interior side wall bottom end and extends vertically away therefrom;

wherein said exterior portion comprises a lower face and a bottom portion having a first distal end and a second distal end;

a first exterior side wall having a top end and a bottom end, wherein said first exterior side wall is connected to said exterior bottom portion first distal end at said first exterior side wall bottom end and extends generally diagonally-vertically away therefrom;

a second exterior side wall having a top end and a bottom end, wherein said second exterior side wall is connected to said exterior bottom portion second distal end at said second exterior side wall bottom end and extends generally diagonally-vertically away therefrom;

a first exterior upper wall segment having a lower portion and an upper portion, wherein said first exterior upper wall segment lower portion is connected to the top end of the first exterior side wall, and the first exterior upper wall segment is connected to the first interior side wall top end;

a second exterior upper wall segment having a lower portion and an upper portion, wherein said second exterior upper wall segment lower portion is connected to the top end of the second exterior side wall, and the second exterior upper wall segment is connected to the second interior side wall top end;

a mounting wing extending substantially perpendicularly from the generally U-shaped body front face, wherein the mounting wing additionally comprises an attachment opening;

an adjustment mechanism partially threaded member comprising a first end and a second end, and further received within the mounting wing attachment opening, the adjustment mechanism partially threaded member having an adjustment head at the first end; and a positioning member attached to the rear face of the generally U-shaped body, wherein said positioning member comprises a front face, a rear face, a lower portion, and an upper portion, wherein said upper portion consists of an apex point, wherein the lower portion of the positioning member is substantially parallel with the lower face of the exterior portion of the generally U-shaped body, and wherein said positioning member apex point extends vertically beyond the interior tool pocket portion lower portion of the generally U-shaped body.

15. The joint installation assisting device of claim 14, further comprising a plurality of defined openings extending from the front face to the rear face of the body member for receiving an anchoring device.

16. The joint installation assisting device of claim 15, wherein the body member is comprised of one of aluminum, aluminum alloy, and plastic.

17. The joint installation assisting device of claim 16, further comprising a plurality of bump stops on the external projection.

18. The joint installation assisting device of claim 17, wherein said bump stops are generally linearly positioned with the apex point.

19. The joint installation assisting device of claim 18, wherein the assisting device comprises a first assisting device and a second joint installation assisting device identical to the first assisting device is provided, and further comprising a connecting rod having a first end and a second end, said first end of the connecting rod is attached to one of the defined openings of the first joint installation assisting device by way of an anchoring device therethrough, and wherein said second end of the connecting rod is attached to one of the defined openings of the second joint installation assisting device by way of an anchoring device therethrough.

* * * * *